US005443209A

United States Patent [19]

VanAllsburg

[11] Patent Number: 5,443,209

[45] Date of Patent: Aug. 22, 1995

[54] HIGH PRESSURE DIESEL FUEL INJECTOR FOR INTERNAL COMBUSTION ENGINES

[75] Inventor: Michael VanAllsburg, Grand Rapids, Mich.

[73] Assignee: Diesel Technology Company, Detroit, Mich.

[21] Appl. No.: 284,366

[22] Filed: Aug. 2, 1994

[51] Int. Cl.[6] ..... F02M 55/00

[52] U.S. Cl. ..... 239/90; 123/446

[58] Field of Search ..... 239/88–91; 123/446, 447, 457, 458, 495, 506, 507

[56] References Cited

U.S. PATENT DOCUMENTS

| | | | |
|---|---|---|---|
| 3,351,288 | 11/1967 | Perr | 239/90 X |
| 4,082,072 | 4/1978 | Johnson | 123/495 |
| 4,378,774 | 4/1983 | Kato | 239/88 X |
| 4,392,612 | 7/1983 | Deckard et al. | 239/88 |
| 4,527,738 | 7/1985 | Martin | 239/90 |
| 4,618,095 | 10/1986 | Spollstra | 239/90 |
| 4,911,127 | 3/1990 | Perr | 123/446 |

*Primary Examiner*—Kevin P. Shaver
*Attorney, Agent, or Firm*—Brooks & Kushman

[57] ABSTRACT

A fuel injector including a housing having a fuel passage connectable at one end to a source of fuel for the ingress or egress of fuel at a suitable supply pressure, a fuel supply chamber in flow communication with the fuel passage, a pump cylinder in the housing, an externally actuated plunger reciprocable in the pump cylinder at a predetermined clearance therewith and defining at one end thereof a pump chamber open at one end for the discharge of fuel during a pump stroke and for fuel intake during a suction stroke of said plunger. The plunger includes a piston and a push rod concentrically located within the piston along an axis thereof, and fixed thereto to preclude relative axial movement along such axis. The push rod includes a head portion extending beyond one end of the piston to be engaged by a plunger actuator to cause a pumping stroke under force, and a stem portion in radial clearance with the piston and engaging the piston at the other end of the piston whereby the force of the plunger actuator is transferred by the push rod directly and only to the other end of the piston, thus precluding placing the said one end of the piston under compression and thereby maintaining the predetermined clearance between the plunger and the housing.

9 Claims, 2 Drawing Sheets

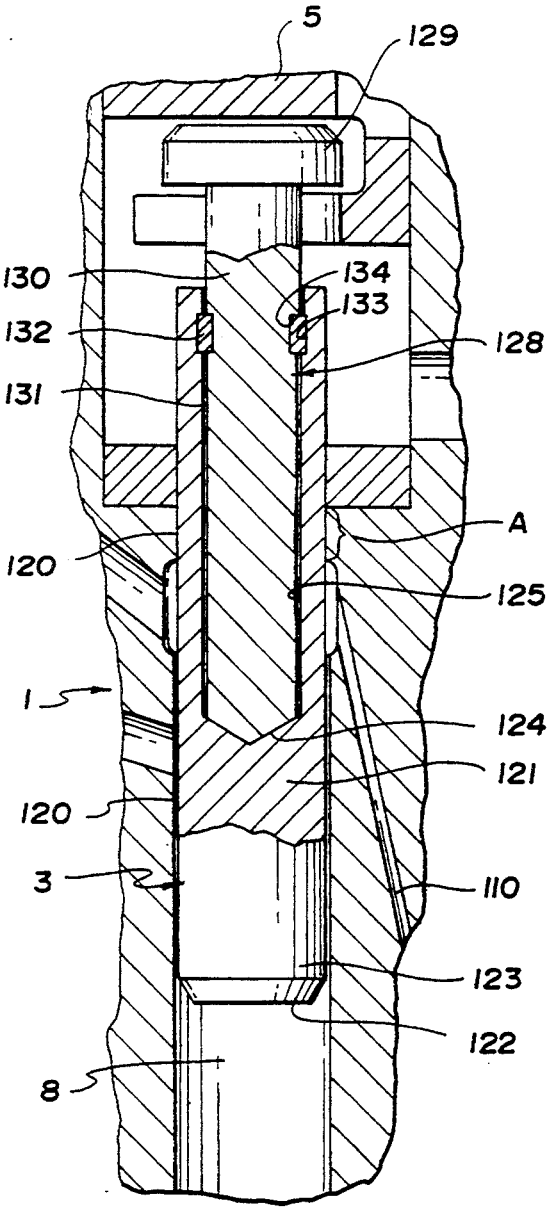
Fig. 3
Fig. 4
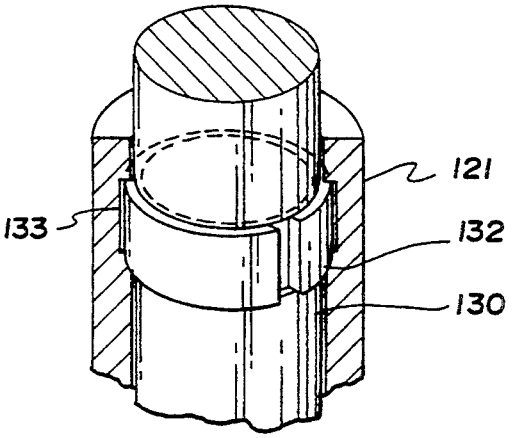
Fig. 5 (PRIOR ART)
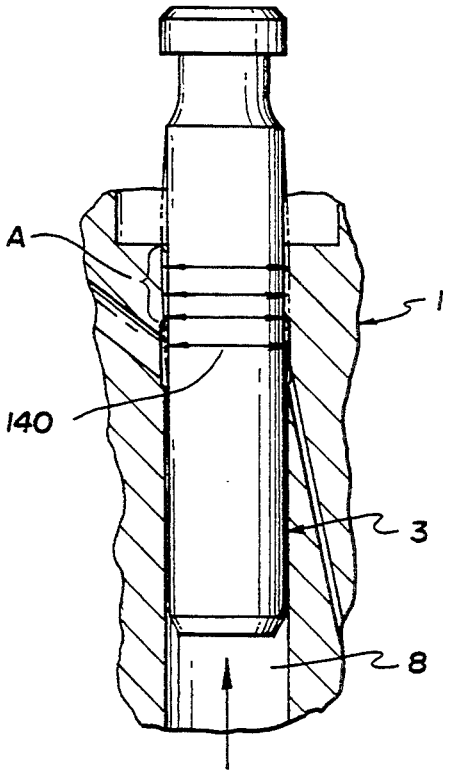

HIGH PRESSURE DIESEL FUEL INJECTOR FOR INTERNAL COMBUSTION ENGINES

TECHNICAL FIELD

This invention is directed to fuel injectors for diesel engines, particularly electronic unit injectors for delivering diesel fuel at ultra-high pressures to heavy duty diesel engines.

BACKGROUND ART

Conventionally, for many years, fuel injectors for heavy duty diesel engines, such as used for example in 12 liter displacement truck engines have been designed to deliver fuel at pressures ranging from 8,000–20,000 psi to the engine's combustion chambers. These are fairly high pressures and have required considerable engineering attention in insuring structural integrity of the injector, good sealing properties, and effective atomization of the diesel fuel within the combustion chamber. However, increasing demands on greater fuel economy, cleaner burning, fewer missions, and Nox control at placed even higher demands on the engine 's fuel delivery system. One means of meeting these demands is to significantly increase the fuel pressure within the injector to as much as 28,000 psi. In terms of developing these pressures within the injector, the task is fairly simple. Since this is largely a matter of proportioning the ratio of the diameter of the primary fuel chamber and pressure inducing reciprocating plunger to the force being delivered to the plunger. Earliest attempts with such a re-design have, however, proved less than satisfactory since increased loads on the plunger as its in compression bearing the compression stroke result in the plunger elastically radially expanding through its compressed length. This expansion on the compression reduces the clearance between the plunger and the plunger cylinder walls, causing scoring, premature wear and ultimately loss of an effective seal between the plunger and the adjacent plunger cylinder wall.

While this problem could be addressed in any number of ways such as a different selection of parts materials, the present invention is directed toward maintaining overall design efficiencies and design parameters which have proved their reliability over the years, and to reconstruct the plunger in such a manner that it can transmit the required loads free of any elastic radial expansion capable of causing interference with the plunger cylinder wall and yet maintaining the same type sealing characteristics of conventional plunger/injector design.

SUMMARY OF THE INVENTION

The present invention contemplates a fuel injector having a reciprocating plunger for developing fuel pressures within the injector and wherein the plunger is so constructed that any radial compression and elastic expansion of the plunger is incapable of affecting the operating clearance between the reciprocating plunger and the plunger cylinder wall.

The invention further contemplates a fuel injector including a housing having a fuel passage connectable at one end to a source of fuel for the ingress or egress of fuel at a suitable supply pressure; a fuel supply chamber in flow communication with the fuel passage, a pump cylinder in the housing, an externally actuated plunger reciprocable in the pump cylinder at a predetermined clearance therewith and defining at one end thereof a pump chamber open at one end for the discharge of fuel during a pump stroke and for fuel intake during a suction stroke of said plunger; the housing including a valve body having a spray outlet at one end thereof for the discharge of fuel; a discharge passage connecting the pump chamber to said spray outlet; a valve controlled passage for effecting flow communication between the pump chamber and the fuel supply chamber; and the plunger including means for precluding elastic radial expansion of the plunger where it contacts the plunger cylinder when under compression as caused by the force of the plunger actuator being transferred to the plunger to pressurize the fuel in the pump chamber, thereby maintaining the predetermined clearance between said plunger and the housing.

The above objects and other objects, features, and advantages of the present invention are readily apparent from the following detailed description of the best mode for carrying out the invention when taken in connection with the accompanying drawings.

BRIEF DESCRIPTION OF THE DRAWINGS

FIG. 3 is an enlarged view of a portion of FIG. 1 showing in greater detail the two-piece construction of the pump plunger in accordance with the present invention;

FIG. 4 is a partial cross-sectional perspective view of the pump plunger of FIG. 3; and FIG. 5 is a schematic illustration of a pump plunger within a fuel injector in accordance with the prior art to schematically illustrate the manner in which the plunge radially expands when under force during a pump stroke.

BEST MODE FOR CARRYING OUT THE INVENTION

Figures 1, 2:
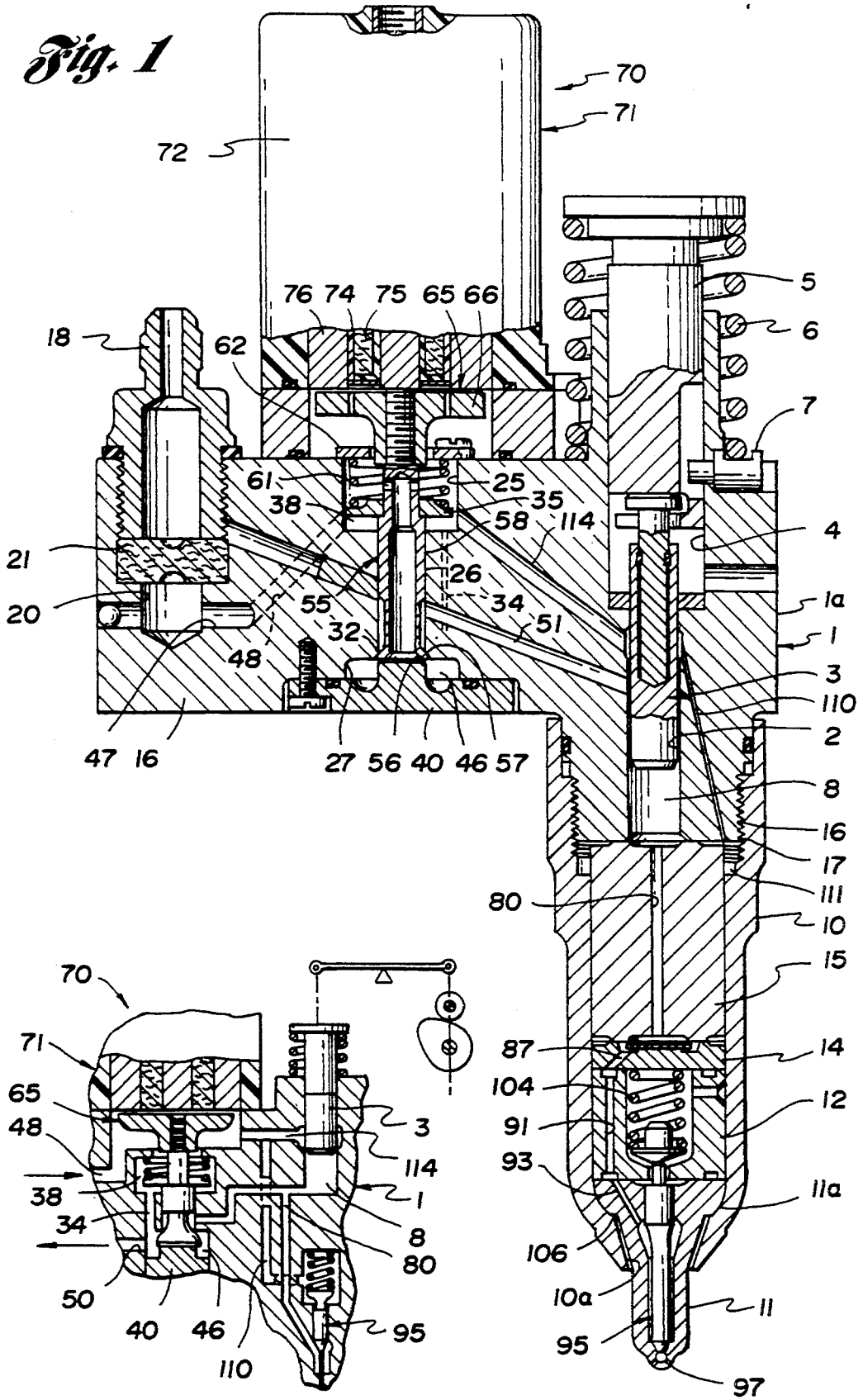
FIG. 1 is a longitudinal sectional view of an electromagnetic unit fuel injector in accordance with the present invention, with elements of the injector being shown so that the plunger of the pump thereof is positioned as during a pump stroke and with the electromagnetic valve means thereof energized, and with parts of the unit shown in elevation.
FIG. 2 is a schematic illustration of the primary operating elements of an electromagnetic unit fuel injector constructed in accordance with the present invention, with the plunger shown during a pump stroke and with the electromagnetic valve means energized.

Referring now to the drawings and, in particular, to FIGS. 1 and 2, there is shown an electromagnetic unit fuel injector constructed in accordance with the invention, that is, in effect, a unit fuel injector-pump assembly with an electromagnetic actuated, pressure balanced valve incorporated therein to control fuel discharge from the injector portion of this assembly in a manner to be described.

In the construction illustrated, the electromagnetic unit fuel injector includes an injector body 1 which includes a vertical main body portion 1*a* and a side body portion 1*b*. The body portion 1*a* is provided with a stepped bore therethrough defining a cylindrical lower wall or bushing 2 of an internal diameter to slidably receive a pump plunger 3 and an upper wall 4 of a larger internal diameter to slidably receive a plunger actuator follower 5. The follower 5 extends out one end of the body 1 whereby it and the plunger connected thereto are adapted to be reciprocated by an engine driven cam or rocker, in the manner shown schematically in FIG. 2, and by a plunger return spring 6 in a conventional manner. A stop pin 7 extends through an upper portion of body 1 into an axial groove 5*a* in the follower 5 to limit upward travel of the follower.

The pump plunger 3 forms with the bushing 2 a pump chamber 8 at the lower open end of the bushing 2, as shown in FIG. 1.

Forming an extension of and threaded to the lower end of the body 1 is a nut 10. Nut 10 has an opening 10*a* at its lower end through which extends the lower end of a combined injector valve body or spray tip 11, hereinafter referred to as the spray tip, of a conventional fuel injection nozzle assembly. As shown, the spray tip 11 is enlarged at its upper end to provide a shoulder 11*a* which seats on an internal shoulder 10*b* provided by the through counterbore in nut 10. Between the spray tip 11 and the lower end of the injector body 1, there is positioned, in sequence starting from the spray tip, a rate spring cage 12, a spring retainer 14 and a director cage 15, these elements being formed, in the construction illustrated, as separate elements for ease of manufacturing and assembly. Nut 10 is provided with internal threads 16 for mating engagement with the external threads 17 at the lower end of body 1. The threaded connection of the nut 10 to body 1 holds the spray tip 11, rate spring cage 12, spring retainer 14 and director cage 15 clamped and stacked end-to-end between the upper face 11*b* of the spray tip and the bottom face of body 1. All of these above-described elements have lapped mating surfaces whereby they are held in pressure sealed relation to each other.

Fuel, as from a fuel tank via a supply pump and conduit, not shown, is supplied at a predetermined relatively low supply pressure to the lower open end of the bushing 2 by a fuel supply passage means which, in the construction shown, includes a conventional apertured inlet or supply fitting 18 which is threaded into an internally threaded, vertical, blind bore, inlet passage 20 provided adjacent to the outboard end of the side body portion 1*a* of the injector body 1. As best seen in FIG. 1, a conventional fuel filter 21 is suitably positioned in the inlet passage 20 and retained by means of the supply fitting 18. A second internally threaded, vertical blind bore in the side body portion 1*a*(not shown) spaced from the inlet passage 20 defines a drain passage with a fitting threaded therein, for the return of fuel as to the fuel tank, also not shown.

In addition and for a purpose to be described in detail hereinafter, the side body portion 1*a* is provided with a stepped vertical bore therethrough which defines a supply chamber 38 and an intermediate or valve stem guide wall 26, terminating at valve seat 32. A second through bore, parallel to but spaced from the valve stem guide wall 26 and extending from fuel supply chamber 38 defines a pressure equalizing passage 34 opening into a spill chamber 46, which is closed by a closure cap 40.

The inlet passage 20 communicates via a horizontal inlet conduit 47 and a connecting upwardly inclined inlet conduit 48 that breaks through the wall 25 with the supply/cavity 38 and the drain passage communicates via a downwardly inclined drain conduit 50 (shown in FIG. 2 only) with the spill cavity 46, this conduit opening through wall 27 into the spill cavity.

A passage 51 provides for the ingress and egress of fuel to the pump chamber 8 opening into the pump chamber 8 at the upper end of the injector body.

Fuel flow between the spill cavity 46 and passage 50 is controlled by means of a solenoid actuated, pressure balanced valve 55, in the form of a hollow poppet valve. The valve 55 includes a head 56 with a conical valve seat surface 57 thereon, and a stem 58 extending upward therefrom. The valve 55, is normally biased in a valve opening direction, downward with reference to FIG. 1, by means of a coil spring 61 loosely encircling valve stem 58. As shown, one end of the spring abuts against a washer-like spring retainer 62 encircling stem portion 58. The other end of spring 61 abuts against the lower face of a spring retainer 35.

Movement of the valve 55 in valve closing direction, upward with reference to FIG. 1, is effected by means of a solenoid assembly 70 which includes an armature 65 having a stem 66 depending centrally from its head. Armature 65 is secured to valve 55.

The solenoid assembly 70 further includes a stator assembly, generally designated 71, having a flanged inverted cup-shaped solenoid case 72. A coil bobbin 74, supporting a wound solenoid coil 75 and, a segmented multi-piece pole piece 76 are supported within the solenoid case 72.

The solenoid coil 75 is connectable, by electrical conductors, not shown, to a suitable source of electrical power via a fuel injection electronic control circuit, not shown, whereby the solenoid coil can be energized as a function of the operating conditions of an engine in a manner well known in the art.

During a pump stroke of plunger 3, fuel is adapted to be discharged from pump chamber 8 into the inlet end of a discharge passage means 80 which admits pressurized fuel to the spray tip 11 via lines 87, 91, 93 to be injected through spray orifices 97 as needle Valve 95 opens against the bias of spring 104 as explained further in U.S. Pat. No. 4,392,612.

Fuel is drained back to the supply/valve spring cavity 38 via an inclined passage 110 in injector body 10 which opens at its lower end into a cavity 111 defined by the internal wall of the nut and the upper end of director cage 15 and at its upper end open into an annular groove 112 encircling plunger 3 and then via an inclined passage 114 for flow communication with the supply/valve spring chamber 38.

Further details of the structure and operation of the injector may be obtained from U.S. Pat. No. 4,392,612, assigned to the assignee of the present application, which is incorporated herein by reference.

FIGS. 3 through 4 show in detail the structure of the two-piece plunger 3. It will be noted that there exists a certain predetermined clearance 120 between the outer walls of the plunger and the adjoining walls of the injector body 1. A minimum clearance is desirable, i.e. a sliding fit, particularly in the region A since it is important the pressurized fuel be sealed from escaping the injector housing other than through drain 110.. The plunger includes a cylindrical piston 121 counterbored along its longitudinal axis a significant depth so as to terminate at the lower $\frac{1}{3}$ portion of the piston or at a point where the length to diameter ratio between the end 122 of the piston head 123 and the stop shoulder 124 formed at the end of the bore 125 is at a ratio less than approximately 2:1.

The plunger also includes a push rod 128 having a radially enlarged head 129 and a reduced diameter stem portion 130 extending from the underside of the head to a point in contact with the stop shoulder 124 of the piston. The cylindrical outer surface of the stem portion 130 is less than the internal diameter of bore 125 to provide a predetermined clearance 131. The amount of this clearance is sized so as to be equal to or slightly greater than the maximum radial expansion of the push rod when subjected to compression forces to be expected under normal operating conditions. A split locking ring 132, shown in FIGS. 3 and 4, may be used to lock the push rod axially within the piston. The locking ring is adapted to be loosely held in the locking groove 133 of the piston prior to insertion of the push rod. When inserted, the push rod will spread the locking ring until it falls into place within a similar radially opposing locking groove 134 located in the push rod, where it will be held in fixed axial position.

During normal operation, as the plunger actuator 5, as seen in FIGS. 1 and 3, forces the plunger downward against the bias of spring 6, the fuel in pump chamber 8 will be compressed and brought to very high fuel pressures, in the order of 25,000 to 28,000 psi. This pressure will not be relieved until needle valve 95 opens and allows fuel to be injected through the spray orifices 97. Even then the pressure developed within the fuel chamber is not substantially reduced. Thus, there is always a fairly high pressure within the fuel chamber and, consequently, a significantly high compressor force is subjected on the plunger throughout at least all of the pump stroke. In conventional practice, even with a conventional solid plunger as shown in FIG. 5, the compressive force at these high pressures causes the plunger to expand as indicated by the arrows 140 thereby reducing the clearance between the plunger and the housing at region A, sometimes to the point of interference. This causes scoring along the plunger and cylinder walls, as well as premature failure of the injector. With the two-piece plunger as shown in FIGS. 1, 3 and 4, the push rod is allowed to radially expand under this compressive force but its radial expansion has no effect on maintaining the constant outer diameter of the piston. All force is transmitted from the head 129 of the push rod through to the stop shoulder 124, the remaining length of the piston, i.e. the length of the piston head 123, is sized relative to the diameter of the piston to preclude any appreciable expansion.

While the best mode for carrying out the invention has been described in detail, those familiar with the art to which this invention relates will recognize various alternative designs and embodiments for practicing the invention as defined by the following claims.

What is claimed is:

1. A fuel injector including a housing means having a fuel passage means connectable at one end to a source of fuel for the ingress or egress of fuel at a suitable supply pressure;

a fuel supply chamber in flow communication with said fuel passage means, a pump cylinder means in said housing means, an externally actuated plunger reciprocable in said cylinder means at a predetermined clearance therewith and defining at one end thereof a pump chamber open at one end for the discharge of fuel during a pump stroke and for fuel intake during a suction stroke of said plunger;

said housing means including a valve body having a spray outlet at one end thereof for the discharge of fuel;

a discharge passage means connecting said pump chamber to said spray outlet;

a valve controlled passage means for effecting flow communication between said pump chamber and said fuel supply chamber; and said plunger including means for precluding elastic radial expansion of the plunger when under compression as caused by the force of the plunger actuator being transferred to the plunger to pressurize the fuel in the pump chamber, thereby maintaining the predetermined clearance between said plunger and the housing.

2. A fuel injector including a housing means having a fuel passage means connectable at one end to a source of fuel for the ingress or egress of fuel at a suitable supply pressure;

a fuel supply chamber in flow communication with said fuel passage means, a pump cylinder means in said housing means, an externally actuated plunger reciprocable in said cylinder means at a predetermined clearance therewith and defining at one end thereof a pump chamber open at one end for the discharge of fuel during a pump stroke and for fuel intake during a suction stroke of said plunger;

said housing means including a valve body having a spray outlet at one end thereof for the discharge of fuel;

a discharge passage means connecting said pump chamber to said spray outlet;

a valve controlled passage means for effecting flow communication between said pump chamber and said fuel supply chamber;

said plunger including a piston and a push rod concentrically located within said piston along an axis thereof, and fixed thereto to preclude relative axial movement along said axis;

said push rod including a head portion extending beyond one end of said piston to be engaged by a plunger actuator to cause a pumping stroke under force, and a stem portion in radial clearance with said piston and engaging said piston at the other end of said piston whereby the force of the plunger actuator is transferred by said push rod directly and only to said other end of said piston, thus precluding placing said one end of the piston under compression and thereby maintaining the predetermined clearance between said plunger and the housing.

3. The invention of claim 2 wherein said piston includes a cylindrical bore extending along said axis open at said one end and terminating at a stop shoulder at approximately the bottom one-third portion of said piston;

said push rod stem portion engaging said piston only at said stop shoulder whereby all force of the plunger actuator is transferred through said push rod to said stop shoulder.

4. The invention of claim 3 wherein said plunger further includes locking means for locking the push rod to said piston in fixed axial relationship.

5. The invention of claim 4 wherein said locking means includes a split snap ring located within respective radially opposing locking grooves provided within said push rod and said piston.

6. An electromagnetic unit fuel injector including a housing means having a fuel passage means connectable at one end to a source of fuel for the ingress or egress of fuel at a suitable supply pressure;

a fuel supply chamber and a spill chamber positioned in spaced apart relationship to each other and in flow communication with said fuel passage means, a pressure relief passage interconnecting said chambers and a valve stem guide bore extending between said chambers with a conical valve seat encircling said guide bore at the spill chamber end thereof, a pump cylinder means in said housing means, an externally actuated plunger reciprocable in said cylinder means at a predetermined clearance therewith and defining at one end thereof a pump chamber open at one end for the discharge of fuel during a pump stroke and for fuel intake during a suction stroke of said plunger;

said housing means including a valve body having a spray outlet at one end thereof for the discharge of fuel;

an injection valve means movable in said valve body to control flow from said spray outlet;

a discharge passage means connecting said pump chamber to said spray outlet;

a valve controlled passage means for effecting flow communication between said pump chamber and said fuel supply chamber and including a solenoid actuated poppet valve having a head with a stem extending therefrom journaled in said valve guide bore for reciprocable movement whereby said head is movable between an opened position and a closed position relative to said valve seat, a solenoid means operatively connected to said housing means, said solenoid means including an armature and a spring positioned in said supply chamber and operatively connected to said poppet valve with said spring positioned to normally bias said poppet valve to said open position;

said plunger including a piston and a push rod concentrically located within said piston along an axis thereof, and fixed thereto to preclude relative axial movement along said axis;

said push rod including a head portion extending beyond one end of said piston to be engaged by a plunger actuator to cause a pumping stroke under force, and a stem portion in radial clearance with said piston and engaging said piston at the other end of said piston whereby the force of the plunger actuator is transferred by said push rod directly and only to said other end of said piston, thus precluding placing said one end of the piston under compression and thereby maintaining the predetermined clearance between said plunger and the housing.

7. The invention as in claim 6 wherein said piston includes a cylindrical bore extending along said axis open at said one end and terminating at a stop shoulder at approximately the bottom one-third portion of said piston;

said push rod stem portion engaging said piston only at said stop shoulder whereby all force of the plunger actuator is transferred through said push rod to said stop shoulder.

8. The invention of claim 7 wherein said plunger further includes locking means for locking the push rod to said piston in fixed axial relationship.

9. The invention of claim 8 wherein said locking means includes a split snap ring located with respective radially opposing locking grooves provided within said push rod and said piston.

* * * * *